US010286401B2

(12) United States Patent
Forsberg et al.

(10) Patent No.: US 10,286,401 B2
(45) Date of Patent: May 14, 2019

(54) DISTRIBUTE PLATE FOR VSI CRUSHER ROTOR

(71) Applicant: SANDVIK INTELLECTUAL PROPERTY AB, Sandviken (SE)

(72) Inventors: Andreas Forsberg, Malmo (SE); Rowan Dallimore, Bath (GB); Knut Kjaerran, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/327,623

(22) PCT Filed: Jun. 26, 2015

(86) PCT No.: PCT/EP2015/064514
§ 371 (c)(1),
(2) Date: Jan. 19, 2017

(87) PCT Pub. No.: WO2016/206754
PCT Pub. Date: Dec. 29, 2016

(65) Prior Publication Data

US 2017/0209866 A1 Jul. 27, 2017

(51) Int. Cl.
*B02C 13/18* (2006.01)
*B02C 13/286* (2006.01)

(52) U.S. Cl.
CPC ..... *B02C 13/1835* (2013.01); *B02C 13/286* (2013.01); *B02C 2013/28681* (2013.01); *B02C 2210/02* (2013.01)

(58) Field of Classification Search
CPC ..... B02C 13/1835; B02C 13/286; B02C 2210/02; B02C 2013/28681
USPC ..... 241/191, 275, 285.1, 300
See application file for complete search history.

(56) References Cited

U.S. PATENT DOCUMENTS 3,193,206 A * 7/1965 Bidwell ..... D21B 1/345 241/282.1
4,065,063 A * 12/1977 Johnson ..... B02C 13/1835 241/275
4,126,280 A * 11/1978 Burk ..... B02C 13/1835 241/275
4,690,341 A * 9/1987 Hise ..... B02C 13/1842 241/275
5,029,761 A * 7/1991 Bechler ..... B02C 13/1842 241/275

(Continued)

FOREIGN PATENT DOCUMENTS

WO 95/10359 A1 4/1995
WO 01/30501 A1 5/2001

(Continued)

*Primary Examiner* — Anthony D Stashick
*Assistant Examiner* — Onekki P Jolly
(74) *Attorney, Agent, or Firm* — Corinne R. Gorski

(57) ABSTRACT

An abrasion wear resistant distributor plate assembly is mountable to protect a rotor within a vertical shaft impact crusher for material fed into the rotor. A distributor plate is arranged so as to be resistant to the operational abrasive wear resulting from contact with a flow of crushable feed material through the crusher rotor. Attachment components are provided around a perimeter of the plate to facilitate mounting and decoupling of the plate at the rotor during servicing or replacement procedures.

13 Claims, 11 Drawing Sheets

(56) References Cited

U.S. PATENT DOCUMENTS

| | | | | |
|---|---|---|---|---|
| 6,382,536 | B1 * | 5/2002 | Lusty | B02C 13/1842 241/275 |
| 2003/0025020 | A1 | 2/2003 | Britzke | |
| 2006/0011762 | A1 | 1/2006 | Dallimore et al. | |
| 2006/0138265 | A1 * | 6/2006 | Strauss | B02C 13/1807 241/275 |
| 2008/0135659 | A1 | 6/2008 | Condon et al. | |
| 2008/0296418 | A1 * | 12/2008 | Dallimore | B02C 13/1835 241/25 |
| 2010/0025512 | A1 * | 2/2010 | Liimatainen | B02C 13/2804 241/300 |
| 2011/0024539 | A1 | 2/2011 | Strauss et al. | |

FOREIGN PATENT DOCUMENTS

| | | | |
|---|---|---|---|
| WO | 2008147274 | A1 | 12/2008 |
| WO | 2011025432 | A1 | 3/2011 |

* cited by examiner

DISTRIBUTE PLATE FOR VSI CRUSHER ROTOR

RELATED APPLICATION DATA

This application is a § 371 National Stage Application of PCT International Application No. PCT/EP2015/064514 filed Jun. 26, 2015.

FIELD OF INVENTION

The present invention relates to an abrasion wear resistant distributor plate mountable to protect a central region of a rotor within a vertical shaft impact crusher from material fed into the rotor.

BACKGROUND ART

Vertical shaft impact (VSI) crushers find widespread use for crushing a variety of hard materials, such as rock, ore, demolished constructional materials and the like. Typically, a VSI crusher comprises a housing that accommodates a horizontally aligned rotor mounted at a generally vertically extending main shaft. The rotor is provided with a top aperture through which material to be crushed is fed under gravity from an elevated position. The centrifugal forces of the spinning rotor eject the material against a wall of compacted feed material or specifically a plurality of anvils or retained material such that on impact with the anvils and/or the retained material the feed material is crushed to a desired size.

The rotor commonly comprises a horizontal upper disc and a horizontal lower disc. The upper and lower discs are connected and separated axially by a plurality of upstanding rotor wall sections. The top aperture is formed within the upper disc such that the material flows downwardly towards the lower disc between the wall sections and is then ejected at high speed towards the anvils. A replaceable distributor plate is mounted centrally on the lower disc and acts to protect it from the material feed. Example VSI crusher distributor plates are described in WO 95/10359; WO 01/30501; US 2006/0011762; US 2008/0135659 and US 2011/0024539.

Due to the abrasive nature of the crushable material, the distributor plate is subject to substantial abrasion wear and requires servicing or replacement at regular intervals. Due to the size and weight of the plate it is a generally difficult task to handle the plate and install and remove it at the rotor. WO 2008/147274 and WO 2011/025432 describe modular distributor plates that may be introduced and removed from the rotor in smaller sections to greatly facilitate handling. However, whilst being advantageous to reduce health and safety risks, such plates can be difficult to assemble and dismantle within the rotor as access via the crusher inspection hatch is typically restricted. Accordingly, what is required is a distributor plate that addresses the above problems.

SUMMARY OF THE INVENTION

It is an objective of the present invention to provide a vertical shaft impact (VSI) crusher distributor plate configured to be resistant to the operational abrasive wear resulting from contact with a flow of crushable feed material through the crusher rotor. It is a specific objective to provide a plate with a maximised operational lifetime that may be conveniently installed and removed at the rotor whilst being adapted for convenient locking attachment and release at the rotor via suitable attachment elements. It is a further specific objective to provide a distributor plate configured to maximise the efficiency of the VSI crusher and in particular the crushing capacity by providing an enhanced rate of flow of material through the rotor during crushing operations.

The objectives are achieved, in part, by providing a modular distributor plate assembly formed from component materials that are selected to optimise the plate (and its component parts) for maximised wear resistance, minimise thickness and weight and simplified attachment/detachment at the rotor. In particular, the present distributor plate comprises a work plate formed from a first material that mounts an insert (for example a tile) formed from a second material having an abrasion wear resistance greater than that of the work plate. Accordingly, a combined thickness of the tile and work plate (in a plane perpendicular to a contact face of the distributor plate) is minimised in addition to minimising the combined weight of the distributor plate to facilitate handling. A distributor plate having a reduced thickness relative to conventional arrangements is advantageous to increase the free flow volume above the distributor plate that is effective to maximise the through flow of material and avoid chocking.

The present distributor plate is further advantageous by comprising a mounting configuration having attachment components configured to secure the plate at the rotor exclusively at and outside a perimeter of the plate. Accordingly, service personnel are required only to access the region around the distributor plate during attachment and removal at the rotor which accordingly reduces the crusher downtime. The low profile configuration of the plate enables a corresponding low profile mounting assembly so as to maximise the available free volume above the plate which is advantageous to increase crushing capacity and efficiency.

According to a first aspect of the present invention there is provided a distributor plate assembly releasably mountable to protect a rotor within a vertical shaft impact (VSI) crusher from material fed into the rotor, the assembly comprising: a main body comprising at least one plate extending continuously within a perimeter of the distributor plate assembly; at least one abrasion resistant insert mounted at the main body to represent at least a part of a contact face of the main body positioned in an upward facing direction within the crusher to contact the material fed into the rotor, an abrasion resistance of the insert being greater than that of the main body; a plurality of attachment elements provided at the perimeter of the main body; a plurality of attachment flanges mountable to the rotor outside the perimeter of the main body to cooperate with the attachment elements to releasably clamp the main body axially to the rotor.

Preferably, a contact face of the main body including the insert is substantially planar. Additionally, the plate that defines the main body is substantially planar comprising opposed planar faces. Such an arrangement is advantageous to minimise the thickness of the plate. Accordingly, a thickness of the plate including the insert is substantially uniform within the perimeter of the main body. Optionally, a thickness of the main body including the insert in the axial direction may be less than 40 mm. Optionally, the thickness of the main body including the insert may be in a range 20 to 40 mm and optionally 28 to 32 mm. Such a configuration is advantageous to maximise the free volume within the rotor and in turn optimise the crushing capacity Preferably, the attachment elements and flanges provided at and/or outside the perimeter of the main body are configured to secure exclusively the distributor plate at the rotor and to lock axially and rotationally the distributor plate at the rotor. In particular, the present distributor plate assembly is devoid of means to mount axially the plate at the rotor within the perimeter of the plate and in particular via a central region of the plate in contrast to conventional arrangements. Accordingly, the distributor plate assembly comprising the main body and inserts may be installed and extracted at the rotor as a single unitary body and mounted in position exclusively via the perimeter mountings.

Preferably, the attachment elements comprise lugs projecting axially downward from the main body each lug having a respective slot or bore to receive at least a part of a respective attachment flange. Preferably, the attachment flanges comprise a plurality of bolts and plate like strips or rods having a first region to engage the slot or bore and a second region to receive the bolt for clamping downwardly onto the rotor and locking the distributor plate axially downward onto the rotor. The attachment flanges may be formed from spring or high carbon steel. Accordingly, the present distributor plate is releasably locked at the rotor via the bolts exerting an axial force onto the strips or rods that act to press against the main body of the plate forcing it into clamping engagement with the base plate that is in turn releasably attached to the VSI crusher shaft and/or end cap of the shaft at which is mounted the rotor. The steel strip like attachment flanges are accordingly low profile mechanisms for securing the distributor plate in position.

Optionally, the main body comprises a work plate to form an upper part of the assembly and a support plate to form a lower part of the assembly. Optionally, the work plate comprises a first material and the support plate comprises a second material that is less abrasion resistant than the first material. Optionally, the work plate comprises an abrasion resistant steel such as manganese steel. Such a dual layer assembly is advantageous to minimise the volume of abrasion wear resistant material to form the work plate at an upper region of the distributor plate assembly whilst the support plate may comprise a less abrasion resistant material. Optionally, a thickness of the work plate including the insert may be in the range 10 to 30 mm or optionally 15 to 20 mm. Optionally, a thickness of the support plate may be in the range 5 to 15 mm or optionally 8 to 12 mm.

According to aspects of the present invention, the work and support plates are coupled together by bonding or mechanical linkages that are independent of the attachment flanges and elements that secure the distributor plate to the rotor, the bonding and mechanical linkages providing a unified coupled assembly that may be collectively installed and removed at the rotor. Optionally, the work and support plates are coupled via rivet welding and/or an adhesive so as to be permanently attached as a unified structure. Such an arrangement facilitates manipulation of the distributor plate to and from the rotor and avoids the need to assemble the plates in situ within the rotor.

Optionally, the insert may comprise at least one ceramic tile or granules. Preferably, the tiles or granules comprise a material comprising aluminium oxide, zirconia and/or silicon carbide. Such materials offer enhanced abrasion resistance relative to conventional tungsten carbides to extend the operational lifetime of the assembly and to provide a plate that is more lightweight to facilitate handling during servicing.

Optionally, the assembly may further comprise a spacer plate positioned to sit against an underside surface of the main body and against the rotor so as to be capable of being mechanically trapped between the rotor and the main body exclusively via the attachment elements and flanges at and/or outside the perimeter of the main body. The spacer plate is advantageous to adjust the axial position of the distributor plate relative to the radially outward positioned wear plates and to accordingly adjust the material flow path over the wear plates to suit material feed sizes and other feed characteristics. Via the low profile configuration of the distributor plate, the present arrangement provides flexibility of the axial positioning of the different wear components that is in turn beneficial to extend the operation lifetime of further wear components within the rotor such as carbide tip plates.

Advantageously, the weight of the present assembly may be less than 15 kg and may be in the range 5 to 15 kg or 5 to 10 kg. Optionally, the work, support and/or spacer plates may be formed as solid plates or may comprise a lattice, honeycomb or other internal structure with cavities to further reduce the overall weight of the plate assembly.

According to a second aspect of the present invention there is provided a vertical shaft impact crusher comprising a distributor plate assembly as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
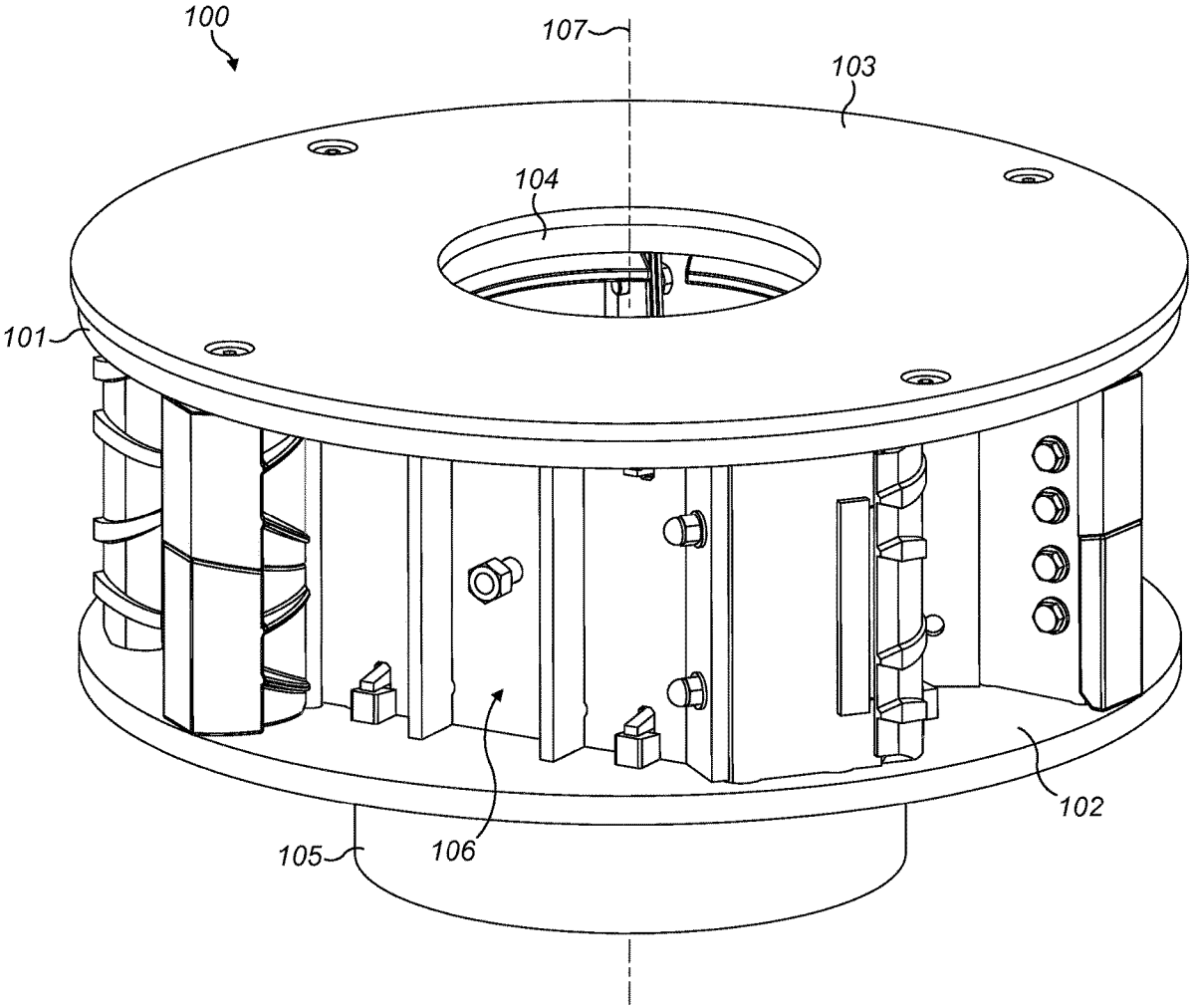
FIG. 1 is an external perspective view of a VSI crusher rotor having upper and lower discs separated by wall sections according to a specific implementation of the present invention.

Referring to FIG. 1, a rotor 100 of a vertical shaft impact (VSI) crusher comprises a roof in the form of an upper horizontal disc 101 having an upper wear plate 103, and a floor in the form of a lower horizontal disc 102. The upper and lower discs 101, 102 are separated by walls 106 that channel the flow of material passing through rotor 100. The lower disc 102 is welded to a hub 105 that is in turn connected to a vertical shaft (not shown) for rotating rotor 100 within a main housing (not shown) of the VSI-crusher. Upper disc 101 has a central aperture 104 through which material to be crushed may be fed into rotor 100.

Upper horizontal disc 101 is protected from crushable material impacting the rotor 100 from above by a top wear plate 103.

Figure 2:
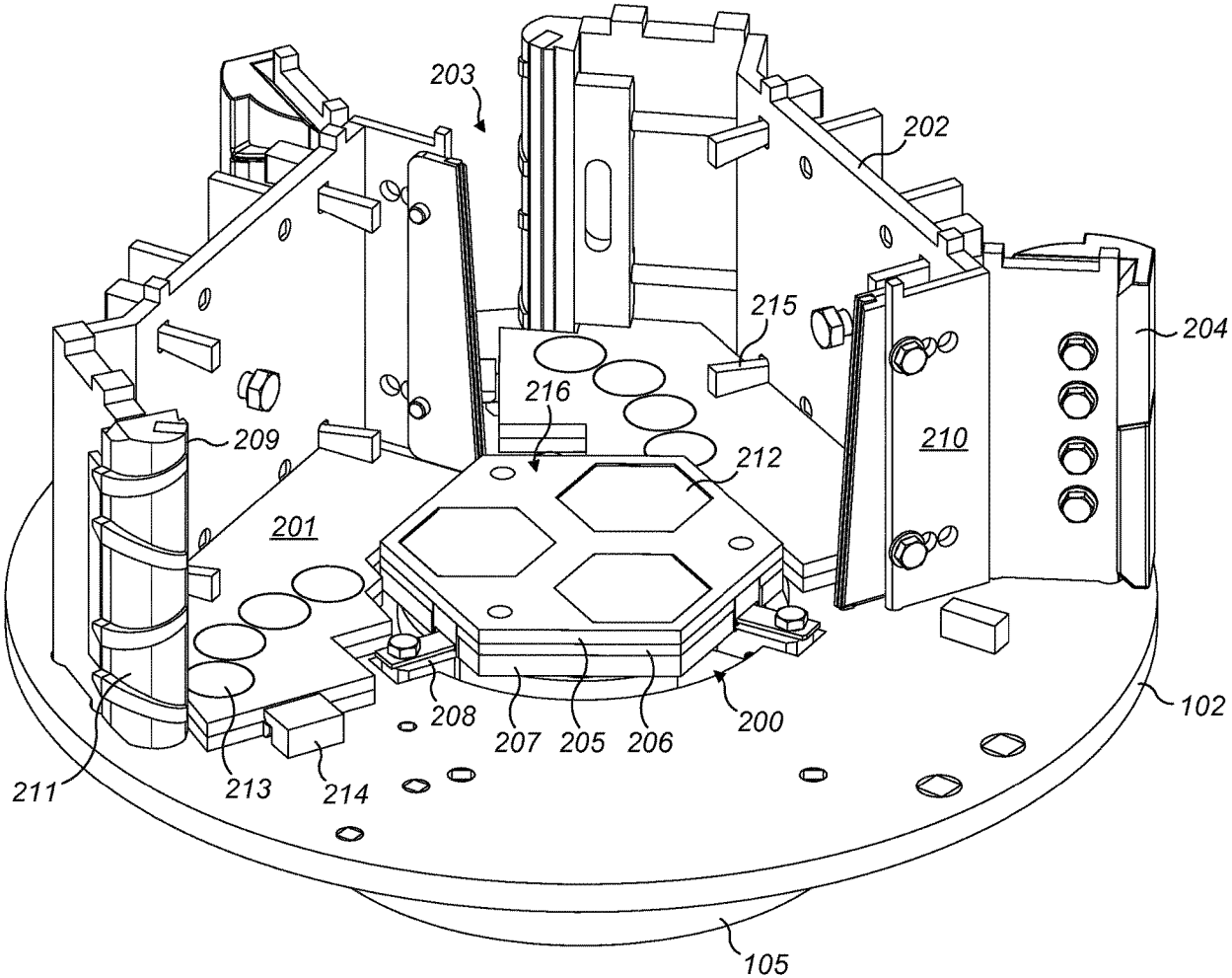
FIG. 2 is a perspective view of the rotor of FIG. 1 with the upper disc and one of the walls and wear plates removed for illustrative purposes.

FIG. 2 illustrates rotor 100 with upper disc 101 and part of wall 106 removed for illustrative purposes. Both the upper and lower discs 101, 102 are protected from wear by three wear plates 201 (only two are illustrated on lower disc 102). The distributor plate 200 is mounted centrally above hub 105 so as to be elevated above lower disc 102. Plate 200 is configured to distribute the feed material received through aperture 104 and to protect lower disc 102 from wear and impact damage caused by the abrasive contact with the feed material. Distributor plate 200 is modular in the axial direction and comprises three vertically stacked plates including in particular an uppermost work plate 205, an intermediate support plate 206 and lowermost spacer plate 207. Plate 207 is attached directly to a base plate 408 that is secured directly to an uppermost end of hub 105 so as to provide an indirect mount of support plate 206 and work plate 205 at rotor 100. Work plate 205 comprises a hexagonal main body within which is mounted abrasion wear resistant inserts 212 in the form of hexagonal tiles. Accordingly, a contact face 216 of distributor plate 200 is defined by the combination of an uppermost surface of work plate 205 and corresponding uppermost surfaces of each wear resistant tile 212. Distributor plate 200 is releasably mounted at rotor 100 (via base plate 408) by a plurality of attachment components indicated generally by reference 208. Components 208 are positioned at and around an outside perimeter of distributor plate 200 and provide exclusively a mechanism for attaching plate 200 to the rotor 100 and in particular hub 105.

Figure 3:
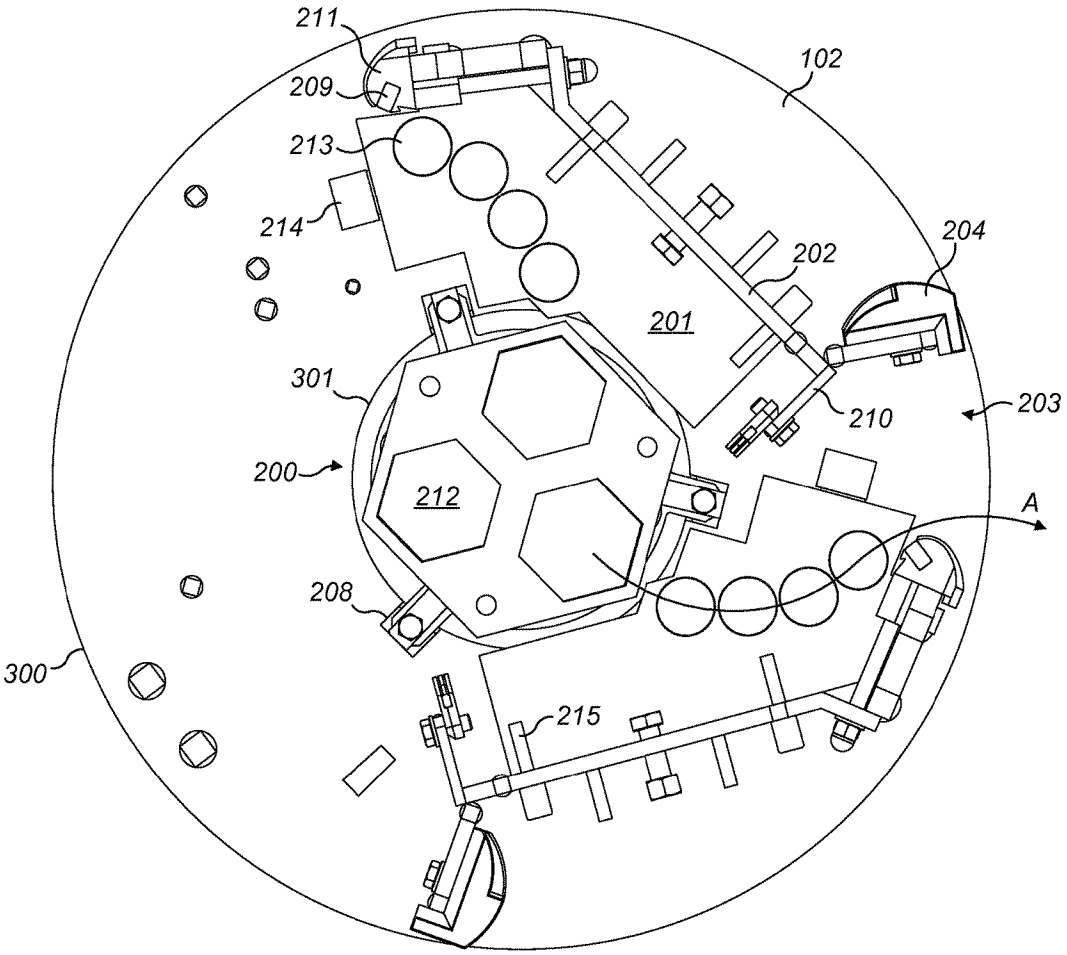
FIG. 3 is a plan view of the lower disc of the rotor of FIG. 2.

Wear plates 201 are positioned to at least partially surround the perimeter of distributor plate 200 and at least partially cover an exposed surface of lower disc 102 (and upper disc 101) from abrasive wear. Referring to FIGS. 2 and 3, each plate 201 is positioned radially between an outer perimeter 300 of disc 102 that is generally annular and comprises a circular central opening 301 positioned approximately at the perimeter of distributor plate 200. Each wear plate 201 is generally elongate and extends in a part circumferential path around annular disc 102 so as to provide a wear surface over which material may flow in a radially outward direction as indicated by arrow A referring to FIG. 3. To increase the wear resistance, each plate 201 comprises a plurality of abrasion wear resistant inserts 213.

Like distributor plate inserts 212, wear plate inserts 213 are formed from a non-metallic material such as a ceramic. Each plate 201 comprises a dual layer structure having a work plate 407 that mounts inserts 213 and a support plate 400 positioned axially intermediate work plate 407 and disc 102. According to the specific implementation, inserts 212 and 213 are formed as tiles and comprise an aluminium oxide ceramic. According to further embodiments, tiles 212, 213 comprise zirconia or a non-tungsten carbide such as silicon carbide whilst the main body of plates 205, 201 are formed from a metal alloy, typically steel.

A wall section 202 extends vertically upward from lower disc 102 and is sandwiched against upper disc 101. Each wall is bordered at a rearward end by rear wall 210. A wear tip shield 204 extends radially outward at the junction of wall section 202 and rear wall 210 to extend vertically upward from disc outer perimeter 300. An opposite end of wall section 202 is bordered by a holder 211 that mounts respectively an elongate wear tip 209 also aligned perpendicular and extending upwardly from one end of each wear plate 201.

Each wear plate 201 is maintained in position at lower disc 102 by a right-angle bracket 214 that is configured to engage a step 401 (and in particular a surface 905 of step 401 referring to FIG. 10) projecting from the lengthwise end of each plate 201. The main length of each plate 201 is further secured against wall sections 202 via a plurality of wedge-shaped plugs 215 that extend through wall sections 202 and abut onto the upward facing surface of each plate 201.

As indicated in FIG. 3, material passing through rotor 100 is configured to fall onto central distributor plate 200, to be thrown outwardly over lower wear plate 201 in a direction of arrow A and then to exit rotor 100 via outflow openings 203 positioned between each wear tip shield 204 and the corresponding wear tip 209. Wear plates 201 are also secured on an underside surface of upper disc 101 and secured in position by corresponding plugs 215 and brackets 214. Accordingly and in use, a bed of material is directed to collect between the upper and lower wear plates 201 against wall sections 202.

Figure 5:
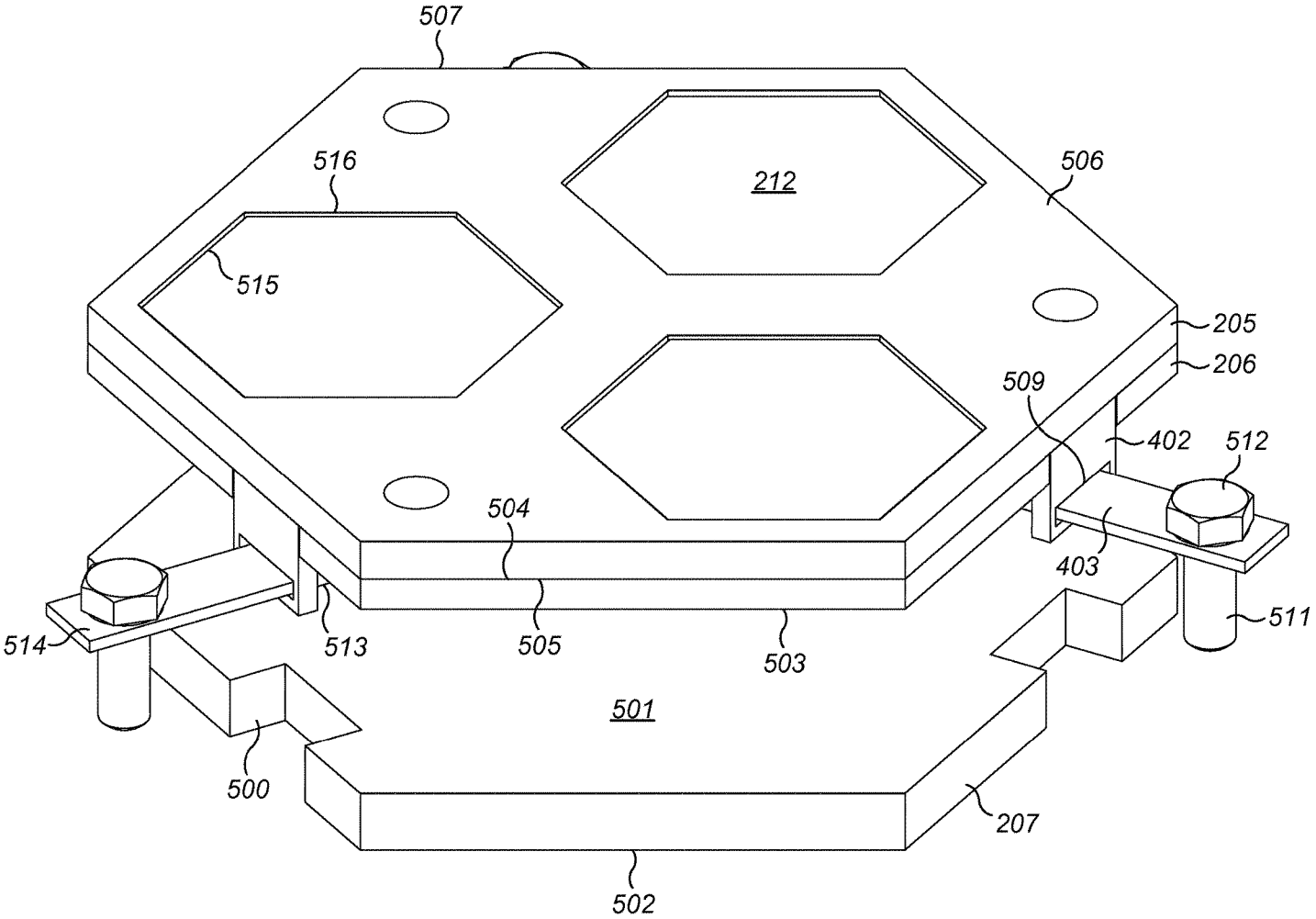
FIG. 5 is an upper perspective view of a central distributor plate of the rotor of FIG. 4.
Figure 6:
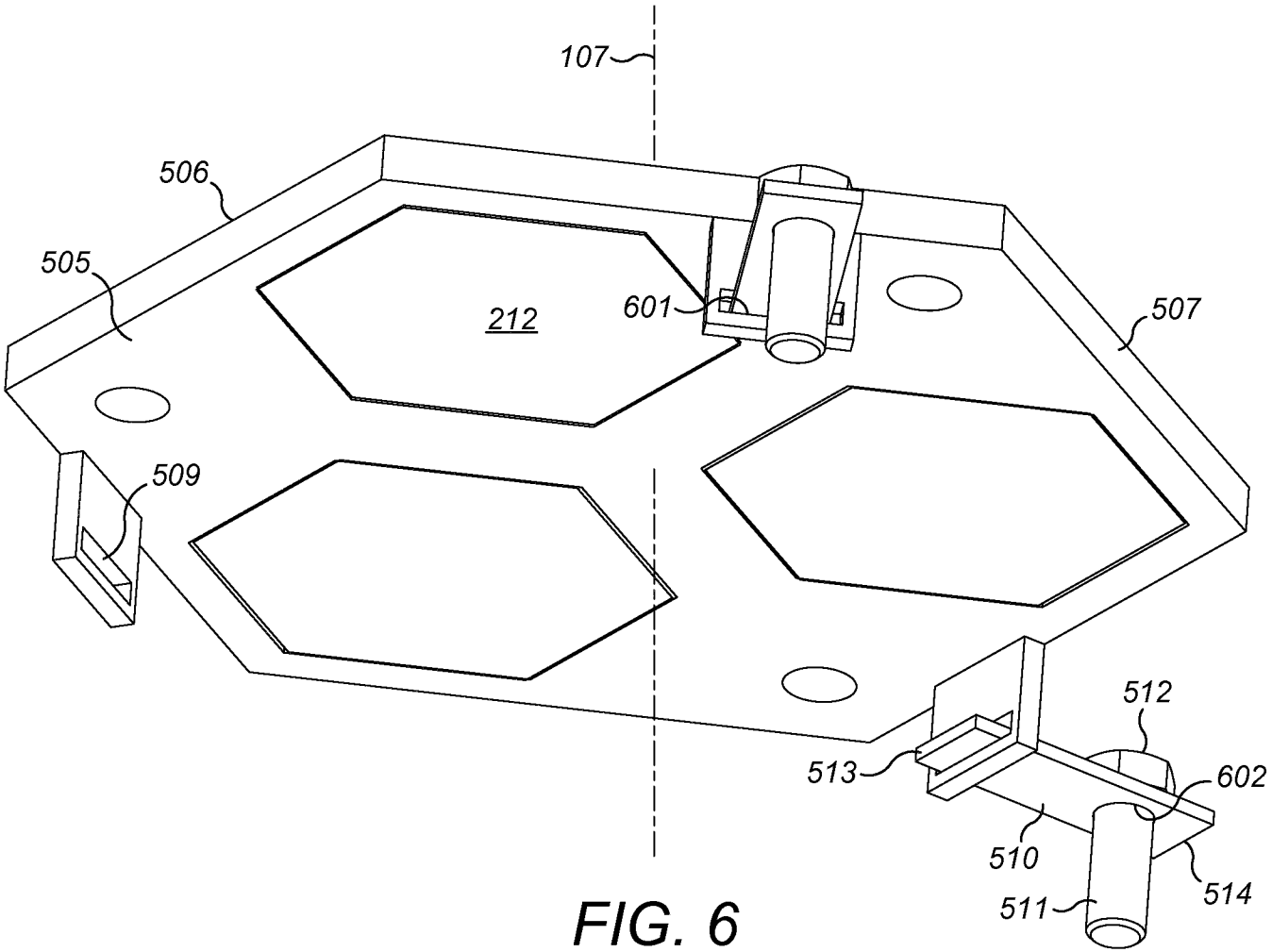
FIG. 6 is an underside perspective view of a work plate part of the distributor plate of FIG. 5.

Referring to FIGS. 5 and 6, distributor plate 200 is releasably locked at rotor 100 via three attachment components 208. Each component 208 comprises principally a set of brackets releasably bolted to rotor 100 that engage part of distributor plate 200 exclusively at and around the outer perimeter of plate 200. In particular, three lugs 402 project downwardly from support plate 206 to provide three regions configured to be engaged by three flanges 403 in the form of short strip or plate-like brackets. Each flange 403 is releasably clamped against respective shoes 405 that project radially outward from a perimeter region of a base plate 408 mounted directly onto hub 105. In particular, each flange 403 is clamped against each shoe 405 via a respective bolt 406.

Each lug 402 is generally planar and formed by a short plate-like body that does not extend beyond a perimeter 507 of distributor plate 200. Each lug 402 projects downwardly from support plate 206 so as to extend below a downward facing surface 503 of plate 206. An axially lowermost region of each lug 402 is positioned axially below face 503 and comprises an elongate slot 509 extending widthwise across lug 402 and aligned generally coplanar with the plane of surface 503. Each lug 402 is spaced apart around plate perimeter 507 by a uniform separation distance. According to the specific implementation, plate 200 comprises a hexagonal shape profile with each lug 402 projecting axially downward from the three sides of the hexagon. Each slot 509 is dimensioned to receive a first end 513 of the plate-like flange 403 whilst a second end 514 comprises an aperture 602 to receive threaded shaft 511 of bolt 406 configured to axially engage shoe 405 and axially clamp flange 403 axially downward against base plate 408 via contact by bold head 512. Accordingly, a lowermost surface 510 of flange 403 is forced against a lower wall 601 that defines slot 509 such that via the mating of bolt 406 into shoe 405, support plate 206 is clamped axially downward onto hub 105. According to the specific implementation, distributor plate 200 comprises axially lowermost spacer plate 207 that is free-standing to be sandwiched between support plate 206 and base plate 408. Spacer plate 207 comprises three cut-out notches 500 that are recessed into a perimeter of plate 207 to provide clearance for the lowermost regions of lugs 402 and flange ends 513. Support plate 206 is mated against spacer plate 207 via contact between a generally upward facing planar surface 501 of spacer plate 207 and downward facing planar surface 503 of support plate 206.

Support plate 206 is non-detachably coupled to work plate 205 via mating contact between an upward facing surface 504 and support plate 206 and a downward facing planar surface 505 of work plate 205. According to the specific implementation, plates 205, 206 are glued together via an adhesive. According to further specific implementations, work plates 205, 206 may be coupled via mechanical attachments including for example rivet welding, thermal bonding, or other mechanical attachments such as pins, screws or bolts. According to the specific implementation, a thickness of work plate 205 in a direction of axis 107 is in the range 15 to 20 mm whilst a corresponding thickness of support plate 206 is in the range 8 to 12 mm. The optional spacer plate 207 may comprise a thickness in the range 20 to 30 mm. According to one embodiment, distributor plate 200 comprises a total thickness in the direction of axis 107 of approximately 30 mm. This lower profile configuration is advantageous to maximise the available (free) volume within rotor 100 between the opposed lower and upper discs 102, 101 so as to maximise the through flow of material and accordingly the capacity of the crusher. The minimised thickness of distributor plate 200 is achieved, in part, by the choice of component materials. In particular, work plate 205 comprises an abrasion resistant metal alloy including for example nodular iron or a high carbon steel. Support plate 206 may comprise a less abrasion resistant steel selected to provide sufficient structural strength whilst being light-weight. Support plate 206 and optionally spacer plate 207 may comprise a solid configuration or may be formed as latticework, honeycomb or may comprise an open structure to further reduce the weight of the distributor plate 200 and facilitate handling and manipulation to, from and within the rotor 100. Providing a separate spacer plate 207 relative to the attached/bonded work and adapted plates 205, 206 is advantageous for processing of specific materials for example with varying feed size and moisture content. By adjustment of the relative axial position of contact face 216 within rotor 100, by selection of a spacer plate 207 having a predetermined axial thickness (or by omitting spacer plate 207) it is possible to optimise the position of contact face 216 axially between lower and upper discs 102, 101 and in particular the position of contact face 216 relative to wear plates 201 and the carbide tips 209. Accordingly, the service lifetime of wear plates 201 and tips 209 may be enhanced.

Figure 11:
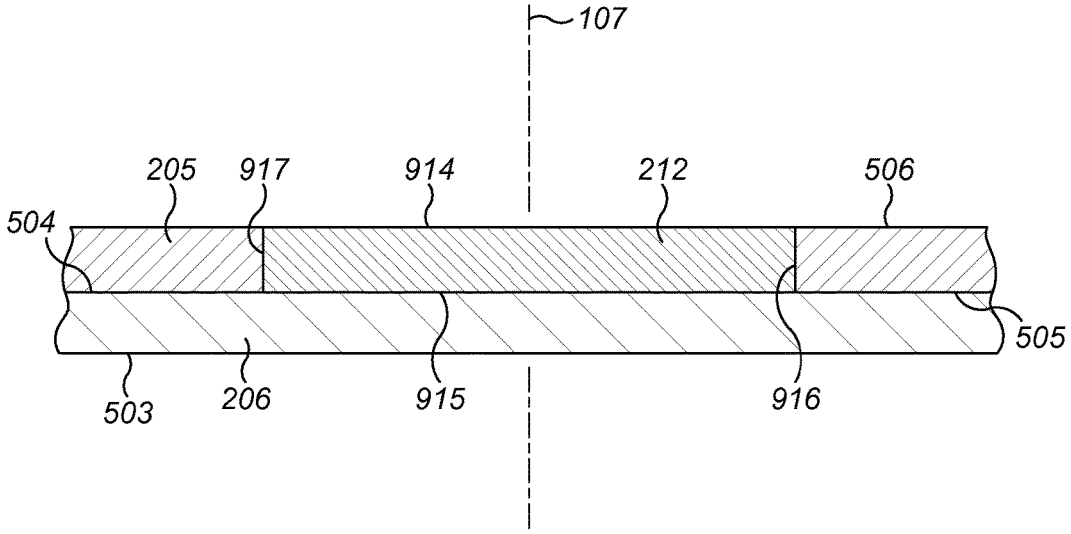
FIG. 11 is a cross section view through a region of the distributor plate of FIG. 5.

The single body work plate 205 is formed with a variety of holes 515 that are contained within the plate perimeter 507 and extend axially between an uppermost work surface 506 and lowermost mount surface 505 that is bonded to support plate surface 504. Each hole 515 is dimension to correspond to the shape profile of a perimeter 516 of each tile 212 so as to mount respectively each tile 212 within the main body of work plate 205 in close fitting frictional contact. Each tile 212 is secured within each respective hole 515 by an adhesive according to the specific implementation. In particular, and referring to FIG. 11, each hole 515 is defined by side walls 916 that are aligned parallel with axis 107. The perimeter 516 of each tile 212 is defined by side faces 917 also aligned parallel with axis 107 and perpendicular to an upward facing planar wear surface 914 and a corresponding downward facing planar mate surface 915. Each tile 212 comprises a thickness in a direction of axis 107 that is equal to a thickness of work plate 205 such that plate work surface 506 is aligned coplanar with the corresponding insert wear surface 914 so as to form a seemingly single continuous planar surface that defines contact face 216. According to the specific implementation, contact face 216 is as a composite surface formed from insert wear surfaces 914 in combination with the exposed regions of work plate work surface 506. The insert mate surface 915 is mated against support plate upward facing surface 504 that provides mounting support for each tile 212 to be retained within work plate holes 515.

Figure 12:
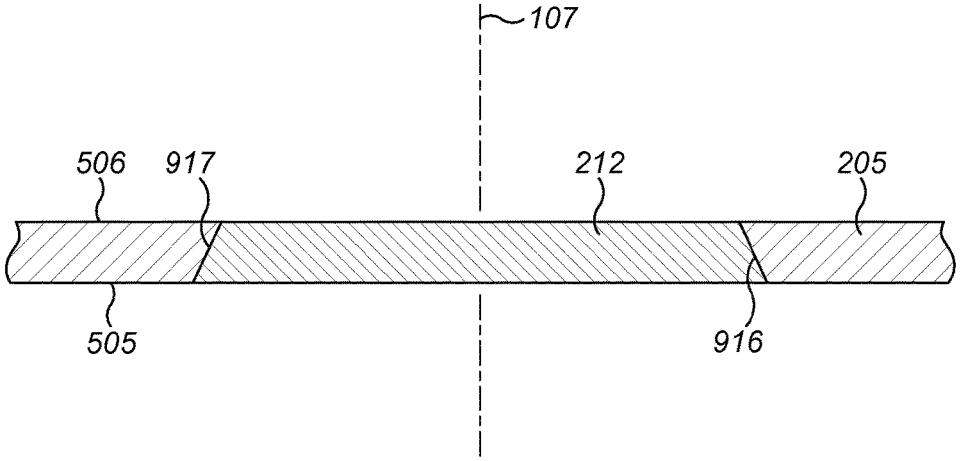
FIG. 12 is a cross section view through an upper region of the distributor plate according to a further specific implementation of the present invention.

FIG. 12 illustrates a further embodiment by which tiles 212 are mounted and retained at work plate 205. According to the further embodiment, the side faces 917 of tiles 212 are tapered so as to extend transverse to axis 107 such that in cross section, each tile 212 comprises a frusto-conical shape profile. Accordingly, the plate sidewalls 916 are also inclined relative to axis 107. In this arrangement, each tile 212 is inserted into work plate 205 from below mount surface 505 so as to be wedged axially into work plate 205 via the tapered contact between surfaces 917 and walls 916. An adhesive may be positioned between surfaces 917 and walls 916 or the tiles 212 may be maintained in position exclusively by the welding of work plate 205 so support plate 206.

According to further embodiments, tiles 212 may comprise granules, chips or randomly sized pieces of high abrasion resistant material embedded within work plate 205 at work surface 506 so as to form a single continuous planar surface to define contact face 216.

Figure 4:
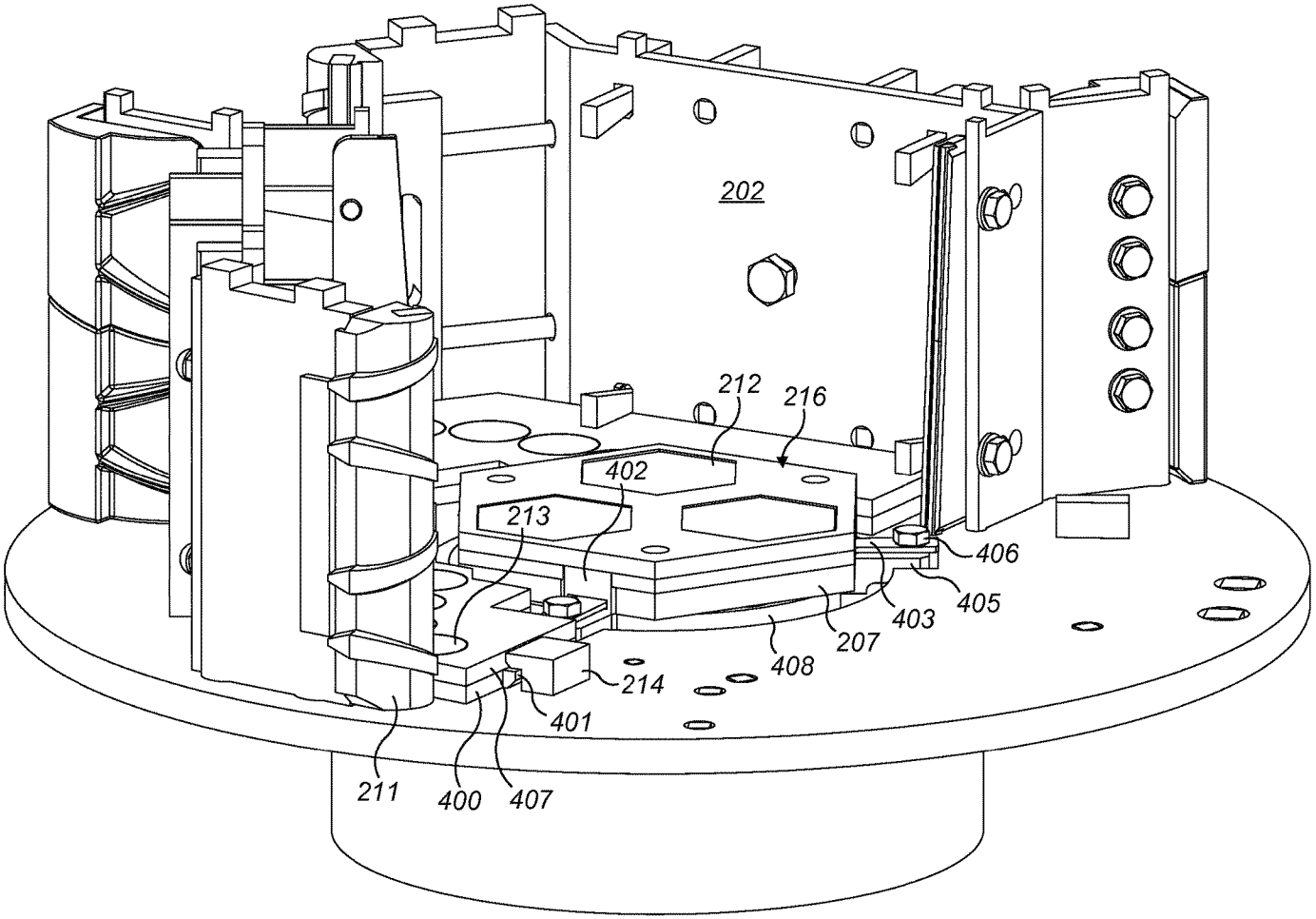
FIG. 4 is a further magnified perspective view of the rotor of FIG. 3.
Figure 7:
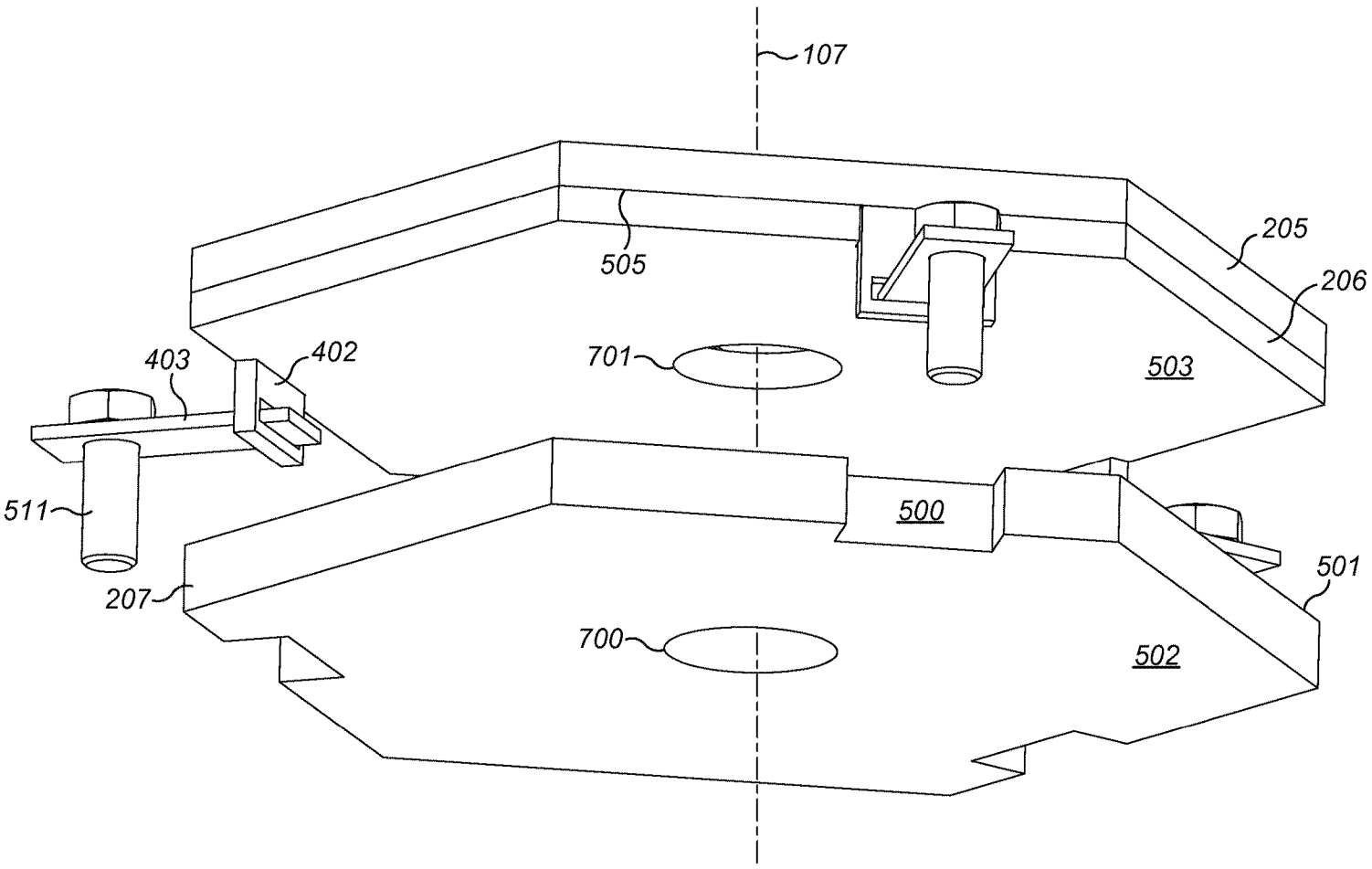
FIG. 7 is an underside perspective view of the distributor plate of FIG. 5.

Referring to FIG. 7, support plate 206 comprises a central bore 701 extending axially through plate 206 between lower and upper faces 503, 504. A corresponding through-bore 700 also extends within lowermost spacer plate 207 between the lower and upper faces 502, 501 to be axially co-aligned with support plate bore 701. Accordingly, distributor plate 200 is adapted to be conveniently maneuvered within rotor 100 so as to be centered onto hub 105. In particular, an axially extending locating spindle (not shown) projects axially upward from hub 105 to extend through base plate 408 and to be received within the central bores 700, 701 of plates 207, 206. Bores 700, 701 each comprise a single cylindrical surface to sit around the locating spindle when the distributor plate 200 is mounted in position as illustrated in FIGS. 2 to 4. The abutment between bores 700, 701 and the locating spindle does not provide any axial locking of plate 200 at rotor 100 and is adapted to for centering only. Distributor plate 200 is releasably mounted at rotor 100 and in particular hub 105 exclusively via the attachment components 208 distributed around the perimeter 507 of plate 200. Such a configuration is advantageous to greatly facilitate mounting and dismounting of the work plate 200 at rotor 100 as personnel need gain access only to the region surrounding plates 200 without being required to assemble plate 200 at a central mounting position within the plate perimeter 507 that is typically required with conventional arrangements. Accordingly, the assembly and dismounting of plate 200 at rotor 100 is time efficient and reduces the crusher downtime during servicing via the crusher inspection hatch. According to specific implementation, a total weight of distributor plate 200 including work plate 205, support plate 206 and spacer plate 207 is in the range 6 to 8 kg. Accordingly, work plate 205, support plate 206 and tiles 212 can be handled conveniently as a unified structure during installation and removal that obviates the need for a modular or segmented construction that would otherwise require assembly at hub 105. Attachment components 208 provide both axial locking of plate 200 onto hub 105 and also lock plate 200 rotationally at axis 107.

Figure 8:
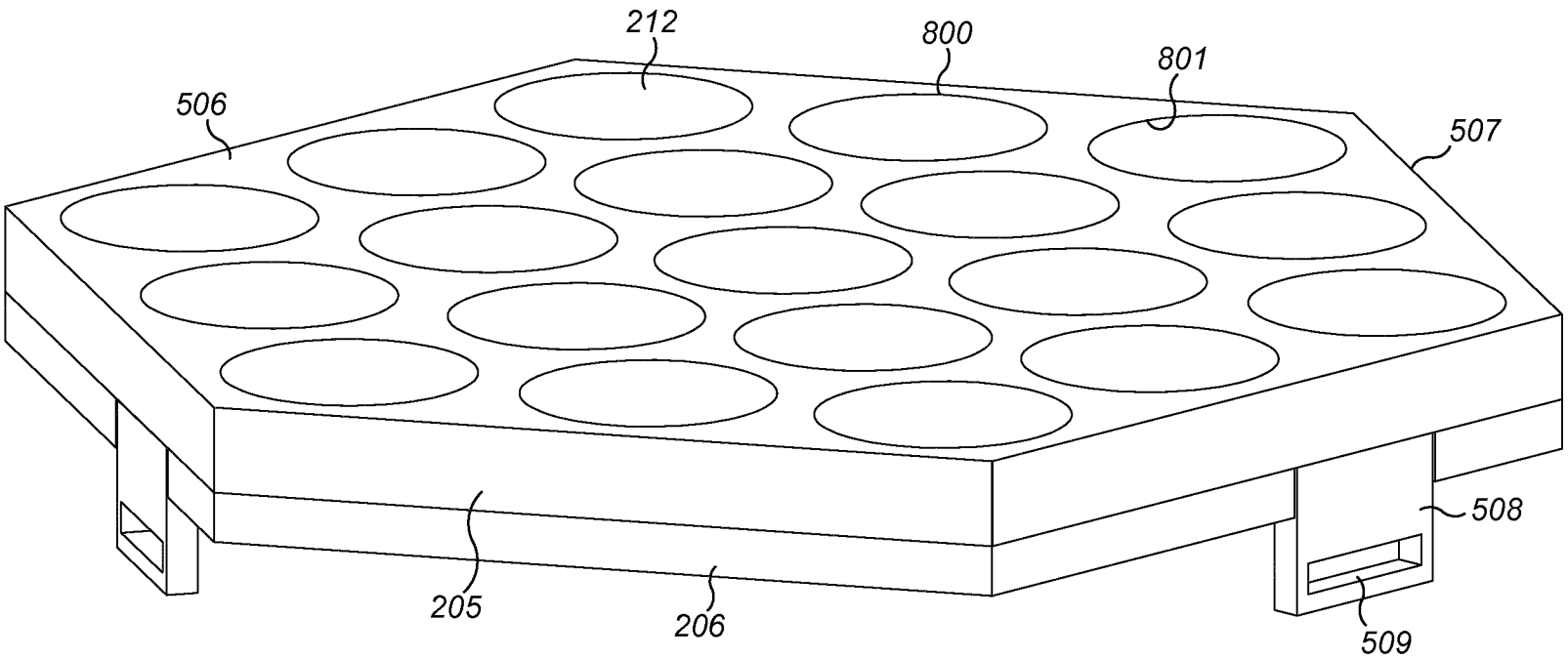
FIG. 8 is a perspective view of part of a distributor plate assembly according to a further specific implementation of the present invention.
Figure 9:
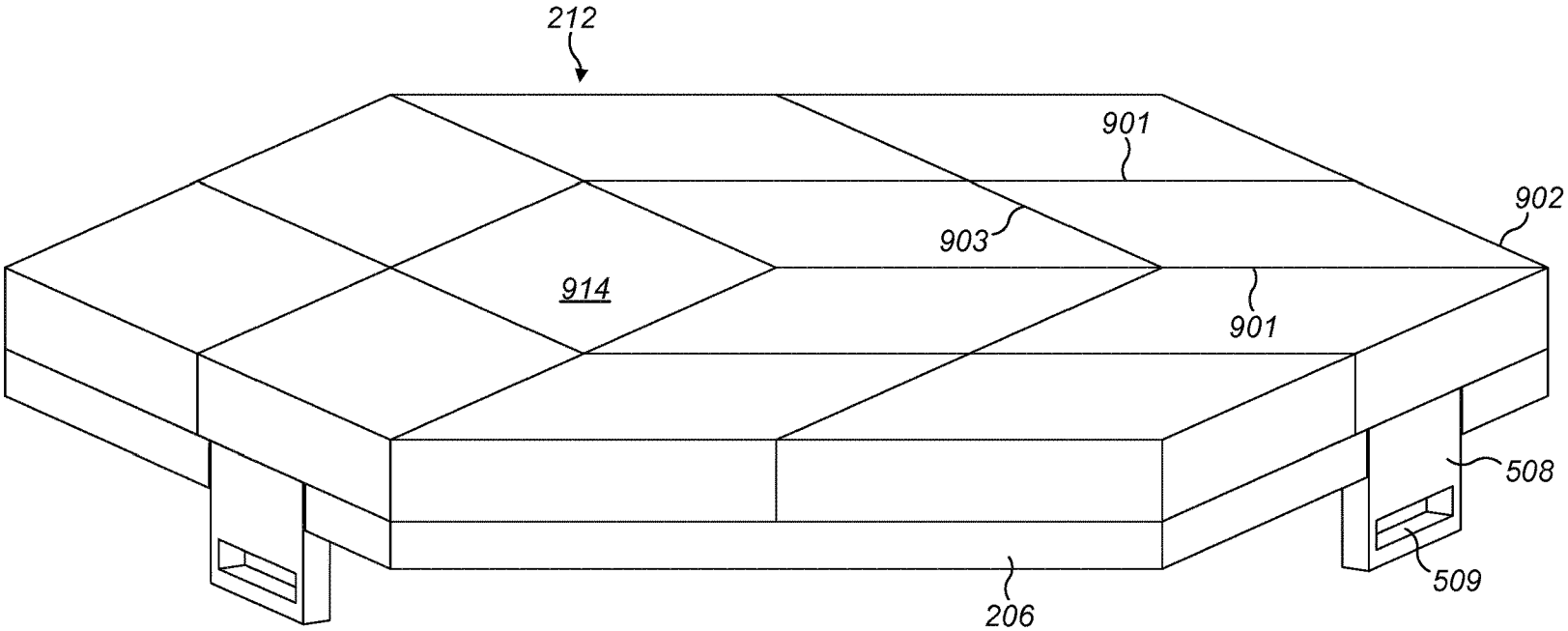
FIG. 9 is a perspective view of part of a distributor plate assembly according to a further specific implementation of the present invention.

Further specific implementations of distributor plate 200 are illustrated in FIGS. 8 and 9. According to the further embodiment of FIG. 8, work plate 205 comprises a plurality of holes 801 having circular shape profiles in the plane of plate 205 to mount respectively a plurality of circular disc shaped tiles 212 having cylindrical side walls or faces 800. According to the embodiments of FIGS. 5 and 8, a total surface area of the combined wear surfaces 914 of tiles 212 is greater than the surface area of the exposed work surface 506 such that the inserts wear surface 914 defines the majority surface area of contact face 216. Referring to the embodiment of FIG. 9, tiles 212 may be tessellated to form an interlocking arrangement mounted upon support plate 206. In particular, each tile 212 comprises side faces 901, 902 and 903 positioned in direct contact with corresponding side faces 901, 902, 903 of adjacent neighbouring tiles 212 mounted above support plate 206. Accordingly, plate perimeter 507 is defined by insert side faces 902 whilst the remaining three side faces 901, 902, 903 are positioned in touching contact with adjacent tiles 212. According to such an embodiment, distributor plate 200 is devoid of an uppermost work plate 205 as each tile 212 is bonded independently onto support plate 206 via mating contact between support plate surface 504 and a downward facing mate face 915 of each tile 212. Each tile 212 is coupled to support plate 206 via an adhesive, rivet welding and/or other mechanical attachments such as bolts, pins, screws etc. Accordingly, contact face 216 is defined exclusively by the wear surface 914 of the coplanar tiles 212.

Figure 10:
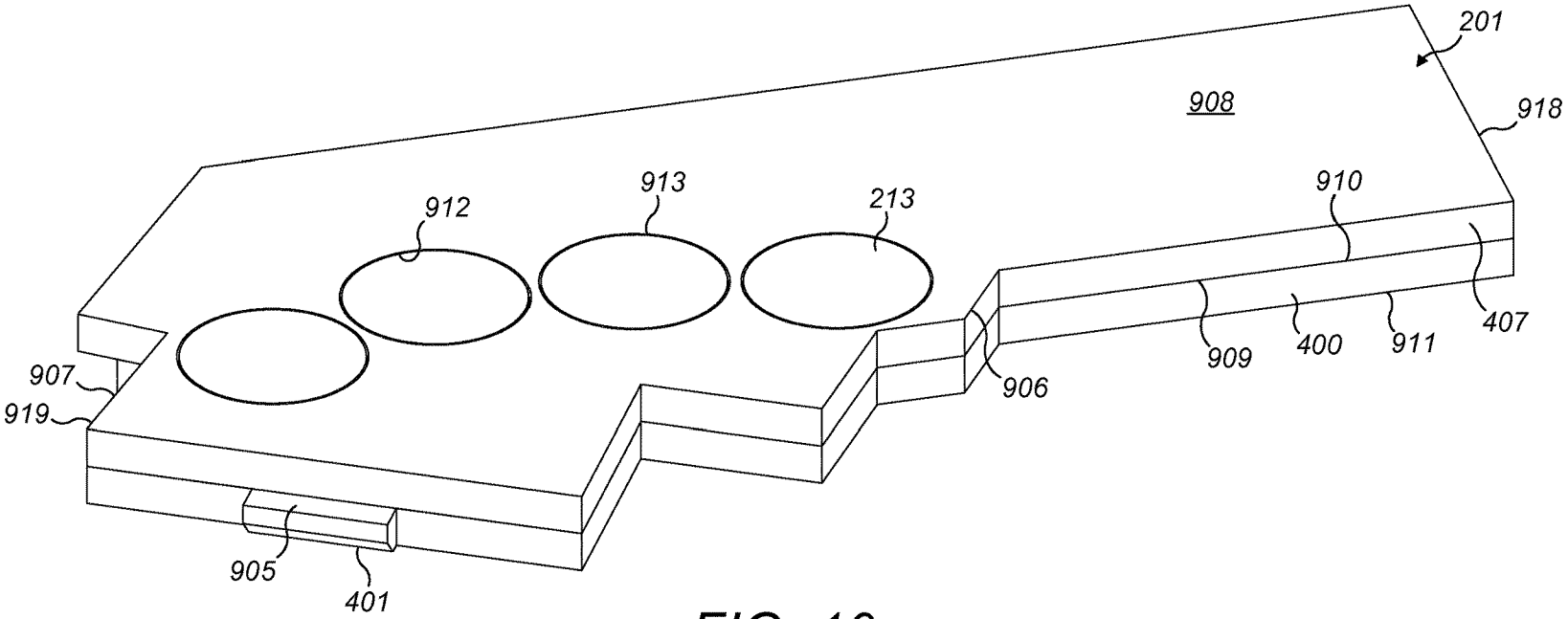
FIG. 10 is an upper perspective view of a wear plate mounted radially outside the central distributor plate of the rotor of FIG. 4 according to the specific implementation of the present invention.

Referring to FIG. 10, each of the wear plates 201 mounted at both the lower and upper discs 102, 101 comprise a generally elongate shape profile having a first end 918 and a second end 919. Each plate 201 comprises a dual layer having an uppermost work plate 407 mechanically attached and/or bonded to an axially lower support plate 400. Each plate 407, 400 is substantially planar and non-detachably coupled via mating between the downward facing surface 909 of work plate 407 and upward facing planar surface 910 of support plate 400. The unified assembly of plates 407, 400 is mountable at each respective disc 101, 102 via a mount face 911 of support plate 400 that is forced axially against the disc 101, 102 via the attachment components 215, 214, 401. An uppermost planar surface 908 represents the majority of the contact face of plate 201 over which material is configured to flow on passing through rotor 100. According to the specific implementation, the work plate 407 and support plate 400 may comprise the same constituent materials and relative thicknesses of the work plate 205 and support plate 206 as described with reference to the distributor plate 200 of FIGS. 5 and 6.

To enhance the abrasion wear resistance of each plate 201, abrasion resistant tiles 213 extend a portion of the length of plate 201 between ends 918, 919. Tiles 213 are also arranged to extend in a widthwise direction across plate 201 between a first side edge 906 and a second opposite side edge 907. In particular, tiles 213 are mounted at plate 201 at a position corresponding to the flowpath of material as it is thrown radially outward from central distributor plate 200 through outflow openings 203 corresponding to flowpath A. Each tile 213, according to the specific implementation, comprises the same abrasion resistant material as distributor plate tiles 212. The mounting of each wear plate tile 213 at wear plate 201 also corresponds to the mechanism of attachment of the distributor plate tiles 212 at work plate 205 as described with reference to FIG. 11 or optionally FIG. 12. That is, each tile 213 comprises a side face 913 that is mated against a sidewall 912 of a respective wall 912 extending through work plate 407 between work surface 908 and mount surface 909. The wear surface 914 of each tile 213 forms a seemingly single continuous planar surface with work surface 908.

According to further embodiments, each work plate 201 may comprise a single plate 400 that mounts a plurality of tessellated abrasion resistant tiles to form the interlocking structure as described with reference to FIG. 9 in which the contact face of each plate 201 is defined exclusively by the wear surface 914 of each tile 213.

The invention claimed is:

1. A distributor plate and rotor assembly, the distributor plate being releasably mountable to protect a rotor within a vertical shaft impact crusher from material fed into the rotor, the assembly comprising:

a main body including a perimeter and at least one plate extending continuously within the perimeter;

at least one abrasion resistant insert mounted at the main body to form at least a part of a contact face of the main body positioned in an upward facing direction within the crusher to contact the material fed into the rotor, a thickness of the at least one plate including the insert being uniform within the perimeter of the main body, and an abrasion resistance of the insert being greater than that of the main body, wherein the contact face of the main body including the at least one insert is planar;

a plurality of attachment elements provided at the perimeter of the main body, wherein the plurality of the attachment elements do not extend beyond the perimeter of the main body; and a plurality of attachment flanges mountable to the rotor outside the perimeter of the main body to cooperate with the attachment elements to releasably clamp the main body axially to the rotor.

2. The assembly as claimed in claim 1, wherein a thickness of the main body including the insert in the axial direction is less than 50 mm.

3. The assembly as claimed in claim 1, wherein the attachment elements and flanges are provided at and/or outside the perimeter of the main body and are configured to secure exclusively the distributor plate at the rotor and to lock axially and rotationally the distributor plate at the rotor.

4. The assembly as claimed in claim 1, wherein the attachment elements comprise a plurality of lugs projecting axially downward from the main body, each lug having a respective slot or bore to receive at least a part of a respective attachment flange.

5. The assembly as claimed in claim 4, wherein the attachment flanges include a plurality of bolts and strips or rods having a first region arranged to engage the slot or bore and a second region arranged to receive the bolt for clamping downwardly onto the rotor and locking the distributor plate axially downward onto the rotor.

6. The assembly as claimed in claim 1, wherein the main body includes a work plate forming an upper part of the assembly and a support plate.

7. The assembly as claimed in claim 6, wherein the work and support plates are coupled together by bonding or mechanical linkages that are independent of the attachment flanges and elements that secure the distributor plate to the rotor, the bonding and mechanical linkages providing a unified coupled assembly that may be collectively installed and removed at the rotor.

8. The assembly as claimed in claim 6, wherein the work plate comprises a first material and the support plate comprises a second material that is less abrasion resistant than the first material.

9. The assembly as claimed in claim 1, wherein the insert includes at least one ceramic tile or granules.

10. The assembly as claimed in claim 9, wherein the tiles or granules are made of a material comprising aluminium oxide, zirconia and/or silicon carbide.

11. The assembly as claimed in claim 1, further comprising a spacer plate positioned against an underside surface of the main body and against the rotor so as to be capable of being mechanically trapped between the rotor and the main body exclusively via the attachment elements and flanges at and/or outside the perimeter of the main body.

12. The assembly as claimed in claim 1, wherein a weight of the assembly is less than 15 kg.

13. A vertical shaft impact crusher comprising:

a rotor; and a distributor plate assembly releasably mountable to protect the rotor from material fed into the rotor, the distributor plate assembly including a main body having a perimeter and at least one plate extending continuously within the perimeter; at least one abrasion resistant insert mounted at the main body to form at least a part of a contact face of the main body positioned in an upward facing direction within the crusher to contact the material fed into the rotor, a thickness of the at least one plate including the insert being substantially uniform within the perimeter of the main body, and an abrasion resistance of the insert being greater than that of the main body, wherein the contact face of the main body including the at least one insert is substantially planar; a plurality of attachment elements provided at the perimeter of the main body, wherein the plurality of the attachment elements do not extend beyond the perimeter of the main body; and a plurality of attachment flanges mountable to the rotor outside the perimeter of the main body to cooperate with the attachment elements to releasably clamp the main body axially to the rotor.

* * * * *